US012137753B2

(12) United States Patent
Smyczek et al.

(10) Patent No.: US 12,137,753 B2
(45) Date of Patent: Nov. 12, 2024

(54) ATHLETIC BRA

(71) Applicant: Under Armour, Inc., Baltimore, MD (US)

(72) Inventors: Lauren Smyczek, Baltimore, MD (US); Kayla Stevens, Baltimore, MD (US); Allison Hicks, Baltimore, MD (US); Michael Seiz, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 36 days.

(21) Appl. No.: 18/068,912

(22) Filed: Dec. 20, 2022

(65) Prior Publication Data

US 2023/0210195 A1 Jul. 6, 2023

Related U.S. Application Data

(60) Provisional application No. 63/295,752, filed on Dec. 31, 2021.

(51) Int. Cl.
*A41C 3/00* (2006.01)

(52) U.S. Cl.
CPC ..... *A41C 3/0014* (2013.01); *A41C 3/0057* (2013.01)

(58) Field of Classification Search
CPC ..... A41C 3/0057; A41C 3/0014
USPC ..... 2/74–76, 60, 66
See application file for complete search history.

(56) References Cited

U.S. PATENT DOCUMENTS

| | | | | |
|---|---|---|---|---|
| 3,653,233 | A | 4/1972 | Titone | |
| 4,668,557 | A | 5/1987 | Lakes | |
| 5,937,441 | A | 8/1999 | Raines | |
| 6,685,534 | B2 * | 2/2004 | Mitchell | D04B 1/24 450/74 |
| 6,878,320 | B1 | 4/2005 | Alderson et al. | |
| 7,160,621 | B2 | 1/2007 | Chaudhari et al. | |
| 7,247,265 | B2 | 7/2007 | Alderson et al. | |
| 7,252,870 | B2 | 8/2007 | Anderson et al. | |
| 7,435,155 | B2 | 10/2008 | Reinisch et al. | |
| 7,455,567 | B2 | 11/2008 | Bentham et al. | |
| 7,858,055 | B2 | 12/2010 | Lee et al. | |
| 7,910,193 | B2 | 3/2011 | Ma | |
| 8,002,879 | B2 | 8/2011 | Hook | |
| 8,128,457 | B2 | 3/2012 | Reinisch et al. | |
| 8,129,293 | B2 | 3/2012 | Budden et al. | |
| 8,191,429 | B2 | 6/2012 | Hook | |
| 8,304,355 | B2 | 11/2012 | Baldauf et al. | |
| 8,436,508 | B2 | 5/2013 | Kornbluh et al. | |
| 8,480,452 | B2 | 7/2013 | Reinisch et al. | |
| 8,772,187 | B2 | 7/2014 | Ugbolue et al. | |
| 8,915,764 | B2 | 12/2014 | Scott et al. | |

(Continued)

FOREIGN PATENT DOCUMENTS

| | | |
|---|---|---|
| CN | 209883085 U | 1/2020 |
| CN | 211431110 U | 9/2020 |

(Continued)

*Primary Examiner* — Gloria M Hale
(74) *Attorney, Agent, or Firm* — Edell, Shapiro & Finnan, LLC

(57) ABSTRACT

An athletic bra includes a front portion and a rear portion, where the front portion includes a plurality of sections that form regions having different degrees of elasticity. The sections of the front portion are oriented such that a gradient in elasticity is imparted along the front portion between the plurality of sections.

19 Claims, 10 Drawing Sheets

(56) References Cited

U.S. PATENT DOCUMENTS

| | | | | |
|---|---|---|---|---|
| 9,480,287 | B2 | 11/2016 | Black et al. | |
| 9,538,794 | B2 | 1/2017 | Turlan | |
| 9,622,516 | B2 | 4/2017 | Lau | |
| 9,936,755 | B2 | 4/2018 | Blakely et al. | |
| 10,028,540 | B2 | 7/2018 | Shearer | |
| 10,104,925 | B2 | 10/2018 | Farmer et al. | |
| 10,123,575 | B2 | 11/2018 | Funk-Danielson et al. | |
| 10,179,960 | B2 | 1/2019 | Diaz et al. | |
| 10,238,160 | B1 | 3/2019 | Mabon | |
| 10,271,584 | B2 | 4/2019 | Ward et al. | |
| 10,368,590 | B2 | 8/2019 | Diaz et al. | |
| 10,368,591 | B2 | 8/2019 | Funk-Danielson et al. | |
| 10,415,164 | B2 | 9/2019 | Diaz et al. | |
| 10,441,003 | B2 | 10/2019 | Goodwin et al. | |
| 10,448,679 | B1 | 10/2019 | Roddis et al. | |
| 10,477,902 | B1 | 11/2019 | Blecha et al. | |
| 10,544,543 | B2 | 1/2020 | Farmer et al. | |
| 10,568,367 | B2 | 2/2020 | Hawkins-Whetstone | |
| 10,609,966 | B2 | 4/2020 | Huffa et al. | |
| 10,640,896 | B2 | 5/2020 | Barnes et al. | |
| 10,721,974 | B2 | 7/2020 | Bastug | |
| D893,133 | S | 8/2020 | Witek | |
| 10,743,591 | B1 | 8/2020 | Cavosie | |
| 10,779,582 | B2 | 9/2020 | Ward et al. | |
| 2003/0171066 | A1* | 9/2003 | Mitchell | A41C 5/00 450/66 |
| 2003/0171067 | A1* | 9/2003 | Mitchell | A41C 3/0014 450/75 |
| 2005/0136797 | A1* | 6/2005 | Mitchell | A41C 5/00 450/60 |
| 2007/0286987 | A1 | 12/2007 | Anderson et al. | |
| 2008/0011021 | A1 | 1/2008 | Starbuck et al. | |
| 2008/0248710 | A1 | 10/2008 | Wittner | |
| 2009/0119820 | A1 | 5/2009 | Bentham et al. | |
| 2010/0029796 | A1 | 2/2010 | Alderson et al. | |
| 2010/0305535 | A1 | 12/2010 | Leeming et al. | |
| 2011/0046715 | A1 | 2/2011 | Ugbolue et al. | |
| 2011/0155137 | A1 | 6/2011 | Martin | |
| 2011/0156314 | A1 | 6/2011 | Alberg et al. | |
| 2011/0159758 | A1 | 6/2011 | Martin | |
| 2011/0209557 | A1 | 9/2011 | Burns et al. | |
| 2011/0236519 | A1 | 9/2011 | Skertchly | |
| 2012/0055187 | A1 | 3/2012 | Raines et al. | |
| 2012/0129416 | A1 | 5/2012 | Anand et al. | |
| 2012/0142239 | A1 | 6/2012 | Budden et al. | |
| 2013/0071583 | A1 | 3/2013 | Evans et al. | |
| 2013/0134992 | A1 | 5/2013 | Zhu et al. | |
| 2014/0259301 | A1* | 9/2014 | Berns | A43C 9/00 2/336 |
| 2017/0290376 | A1 | 10/2017 | Maheshwari et al. | |
| 2018/0035724 | A1 | 2/2018 | Blibech | |
| 2018/0199651 | A1 | 7/2018 | Blakely et al. | |
| 2018/0242653 | A1 | 8/2018 | Brandt et al. | |
| 2019/0174840 | A1 | 6/2019 | Paulson | |
| 2020/0029631 | A1 | 1/2020 | Tsutsui et al. | |
| 2020/0187570 | A1 | 6/2020 | Huffa et al. | |
| 2020/0260803 | A1 | 8/2020 | Whittaker | |
| 2020/0281281 | A1 | 9/2020 | Crompton | |
| 2020/0323278 | A1 | 10/2020 | Roddis et al. | |
| 2020/0337390 | A1 | 10/2020 | Ward et al. | |

FOREIGN PATENT DOCUMENTS

| | | | |
|---|---|---|---|
| CN | 111757680 | A | 10/2020 |
| GB | 2577116 | B | 9/2020 |
| JP | 6661122 | B1 | 3/2020 |
| WO | 2010/125397 | A1 | 11/2010 |
| WO | 2017/126684 | A1 | 7/2017 |
| WO | 2017/191806 | A1 | 11/2017 |
| WO | 2019/163201 | A1 | 8/2019 |
| WO | 2020/165996 | A1 | 8/2020 |
| WO | 2020/169370 | A1 | 8/2020 |

* cited by examiner

ATHLETIC BRA

CROSS-REFERENCE TO RELATED APPLICATION

This application claims priority from U.S. Provisional Patent Application No. 63/295,752, filed Dec. 31, 2021, and entitled "Athletic Bra," the entire disclosure of which is incorporated herein by reference.

FIELD

The present invention relates to an article of apparel and, in particular, to an athletic bra.

BACKGROUND

Brassieres or bras are worn by many women to support their breasts and to facilitate a desirable shape and appearance. During athletic activities such as running, excessive breast motion can lead to discomfort and even potential damage to breast anatomy. Accordingly, bras are made with a variety of constructions to provide different amounts of support to different areas of the breasts. Conventional athletic bras provide support by restricting motion via compression or encapsulation. Compression bras apply uniform pressure to flatten the breasts against the chest. Encapsulation bras have a cup for each breast, usually with an underwire, that separates the breasts and holds them in place. These approaches, while generally effective, are focused on limiting all movement. As a result, conventional bras may cause discomfort via the increased pressure applied by the garment or by the underwire pressing into the wearer. It would be desirable to provide an athletic bra capable of providing fit and motion control without one or more of the above noted drawbacks.

BRIEF SUMMARY

In example embodiments, athletic bra comprises a front portion and a rear portion, the front portion comprising a plurality of sections that form regions having different degrees of elasticity, stretch or recovery, the sections including a first cup section and a second cup section located at a central area of the front portion. The sections of the front portion are oriented such that a gradient in elasticity is imparted along the front portion in which each section differs in elastic modulus at the different sections. For example, the greatest degree of elasticity can be at the cup sections.

For example, an athletic bra may be formed of a front portion, a rear portion, and a pair of wing sections that connect the front portion with the rear portion on either side of the bra. The front portion can comprise a plurality of sections that form regions having different degrees of elasticity, the sections including: a first cup section contoured to receive a portion of a first breast of a user when the bra is worn by the user, the first cup section having a degree of elasticity defined by a first elastic modulus; a second cup section contoured to receive a portion of a second breast of a user when the bra is worn by the user, the second cup section having a degree of elasticity defined by the first elastic modulus; a midsection disposed between the first and second cup sections, the midsection having a degree of elasticity defined by a second elastic modulus; a first peripheral side section disposed along a side portion of the first cup section and a second peripheral side section disposed along a side portion of the second cup section, the first peripheral side section having a degree of elasticity defined by the second elastic modulus; a bridging section disposed above the first and second cup sections, the bridging section having a degree of elasticity defined by a third elastic modulus; and a cradle section disposed below the first and second cup sections, the cradle section having a degree of elasticity defined by a fourth elastic modulus. The first, second, third and fourth elastic moduli can each differ from each other.

The gradient in elasticity for sections within the front portion of the bra can provide a zonal dampening effect to support more harmonized, synchronous movement of the breasts of the user wearing the bra with the strides or other movements of the user during exercises and athletic activities.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION

Figure 1A:
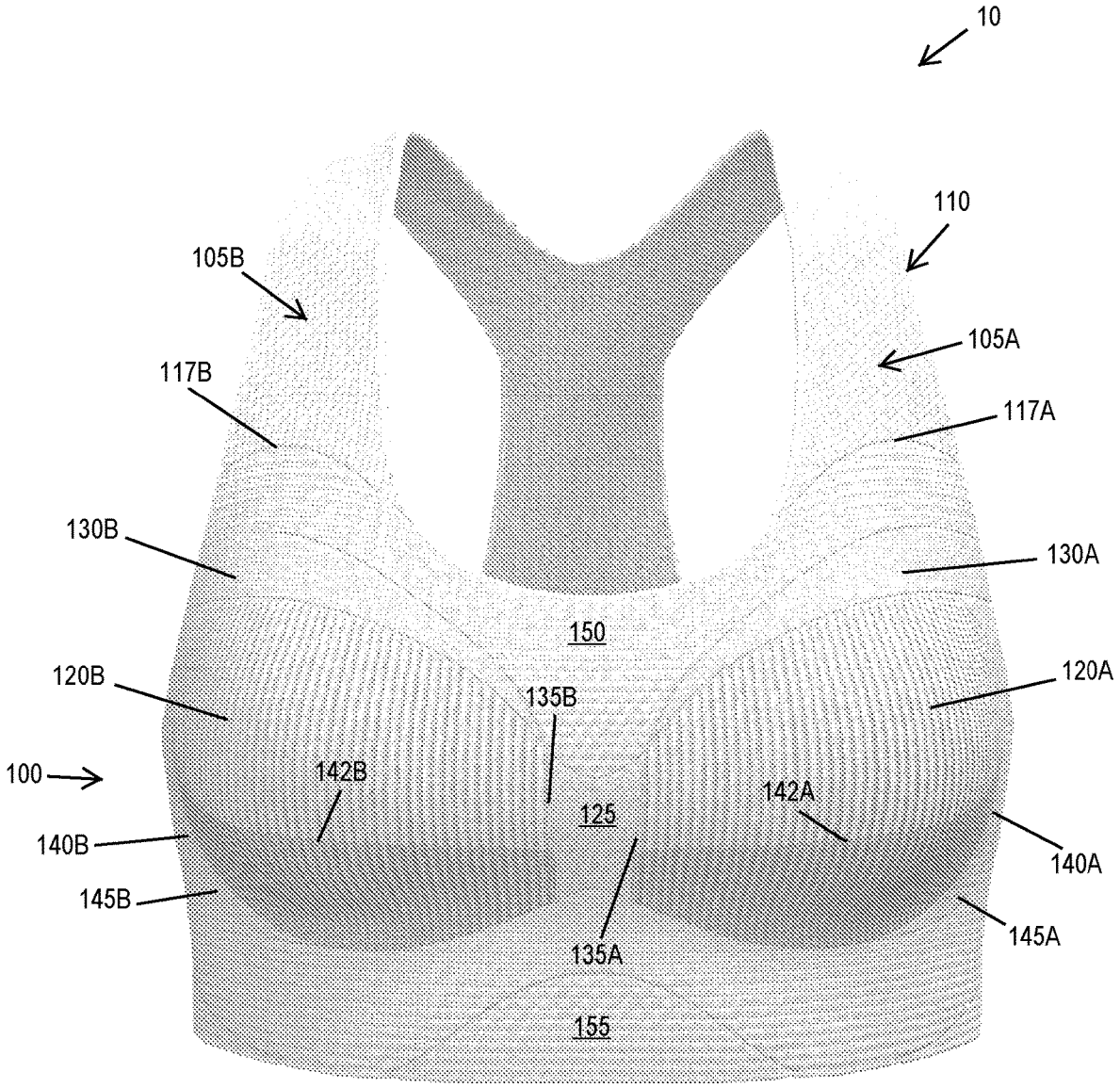
FIG. 1A is a front view of an athletic bra including a support panel in accordance with an embodiment of the invention.
Figure 1B:
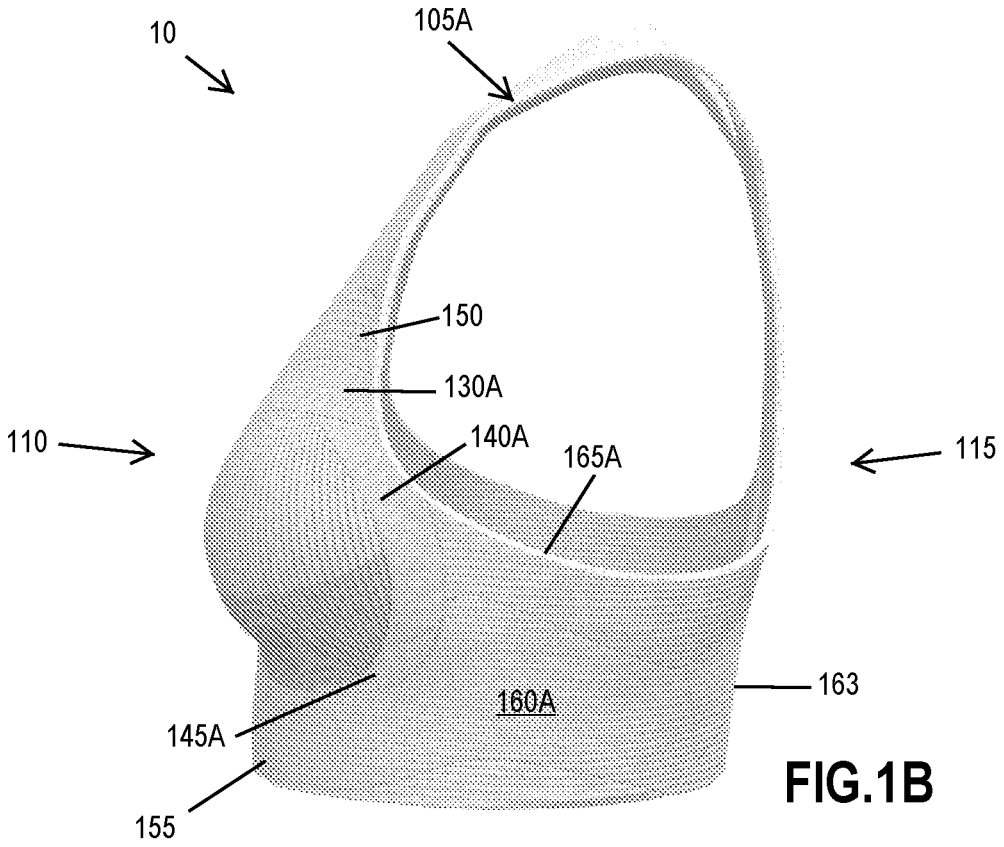
FIG. 1B is a left-side view of the athletic bra shown in FIG. 1A.
Figure 1C:
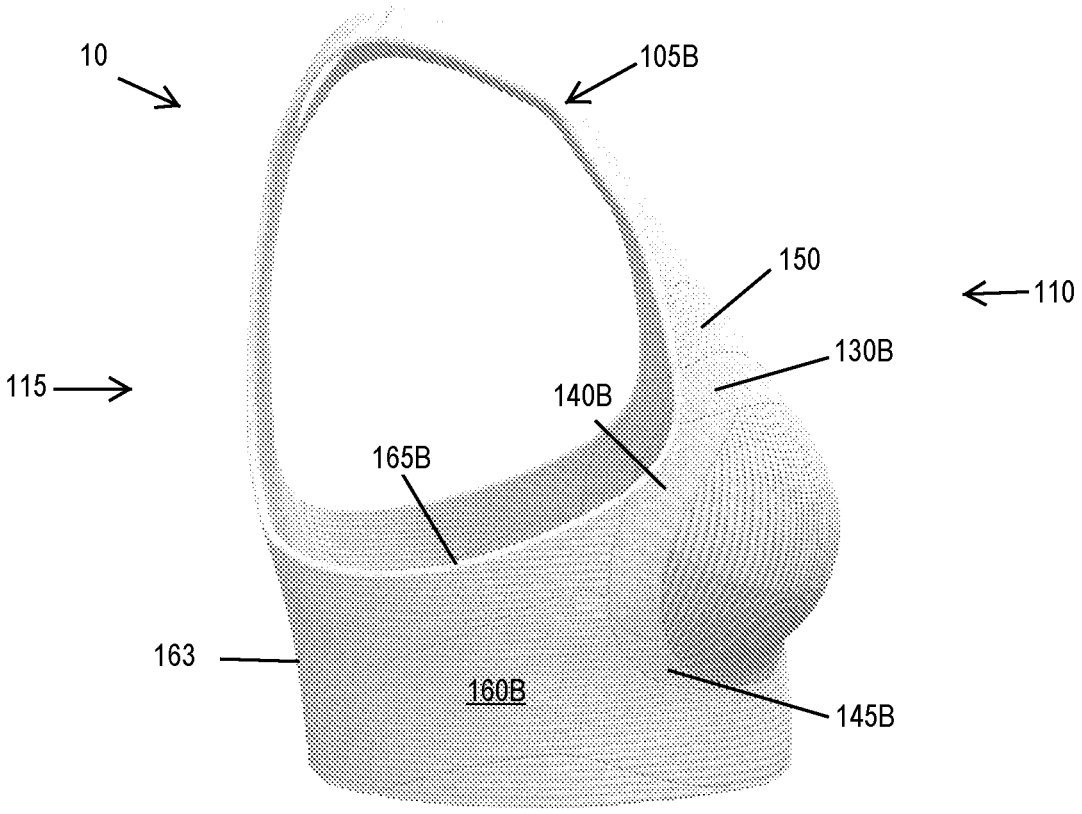
FIG. 1C is a right-side view of the athletic bra shown in FIG. 1A.
Figure 1D:
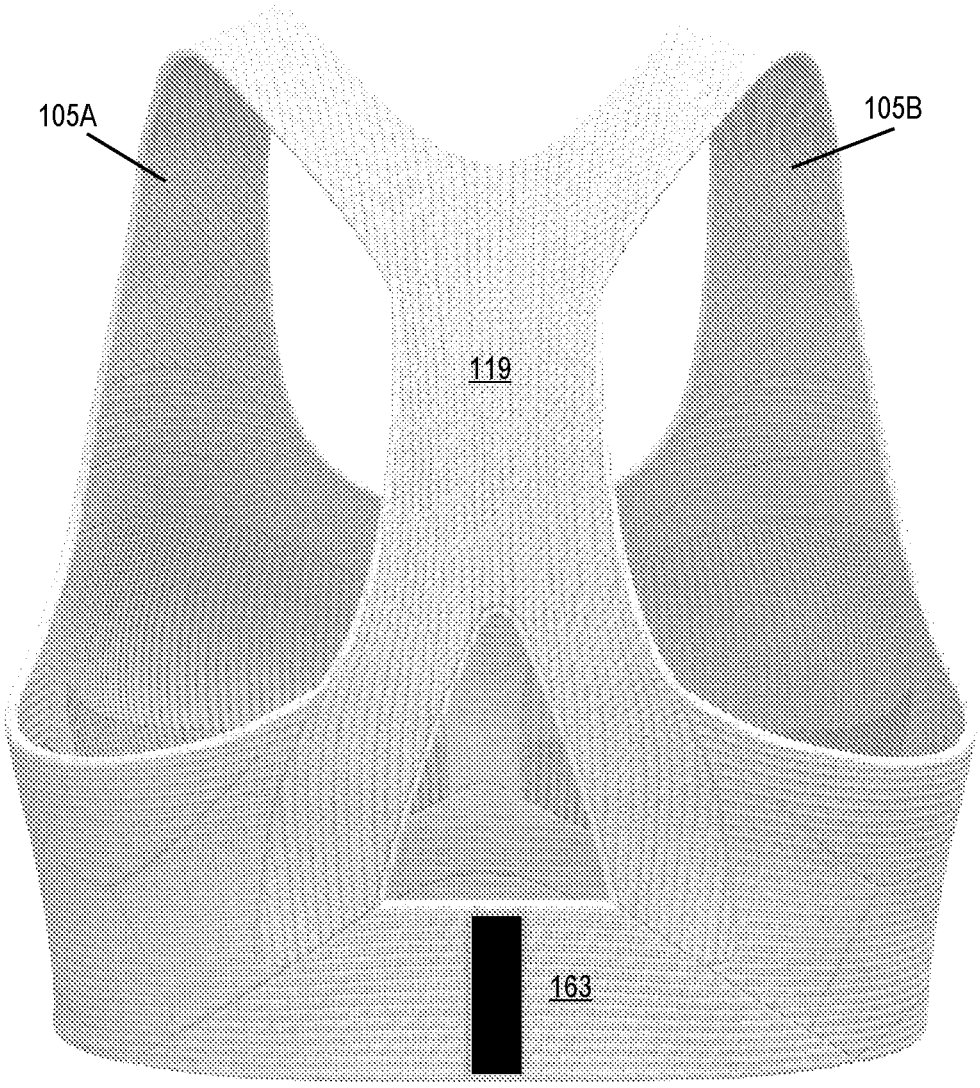
FIG. 1D is a rear view of the athletic bra shown in FIG. 1A.

In the following detailed description, reference is made to the accompanying figures which show, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

During exercise such as running, each breast moves independently of the torso in what is described as a butterfly formation, with 50% of this movement occurring in a vertical direction, 25% in a forwards/backwards direction and 25% in a side-to-side direction. Discomfort may result from this movement. This discomfort may be exacerbated when breast motion is out of synchrony with body motion. Due to the mass of the breast, a time delay is generated between body motion and breast motion, increasing the stretch on connective tissue known as Cooper's ligaments, which provide suspensory support to the breast. This becomes pronounced on longer runs—it is believed that the magnitude of breast kinematics may increase over an extended run distance, and the magnitude of strain placed on these tissues may increase over time, due to the repeated loading over extended running distances.

Sports bras attempt to minimize breast motion during exercise, thereby improving the overall comfort of the wearer. Additionally, running kinematics may be affected by level of breast support, with runners altering their running kinematics due to the magnitude of breast displacement experienced. This, in turn, could significantly affect running performance. Reduced levels of breast support elicit certain alterations in running kinematics that have previously been related to less economical running styles and potentially detrimental to performance (e.g., greater arm extension, suppressed arm abduction, more forward lean of the thorax, shorter step length, and less acute knee flexion). Conversely, with higher levels of breast support, the mechanical profile represents a more economical running style (e.g., reduced arm extension, greater step length, and a more acute knee flexion). Accordingly, due to level of exertion, the sports bra support may ultimately influence a woman's breathing rate, lung capacity and thermoregulation during exercise.

One aim of the present invention is to decrease the anti-synchrony between breast and body movement, permitting each breast to move independently while controlling the directional movement and/or reducing multiplanar breast velocity throughout an exercise period.

Referring to FIGS. 1A-1D and 2, an athletic bra 10 includes a lower, body portion 100 and an upper, strap system including a first or left strap 105A and a second or right strap 105B extending from a front bra portion 110 to a rear bra portion 115. As shown, the straps are coupled to the body 100 at the bra's front portion 110 at a corresponding apex 117A, 117B, with the straps combining in the back bra portion 115 to form a single, racerback-style strap 119 larger than each individual strap 105A, 105B. The body 100 along the front bra portion 110 includes a first or left cup 120A separated from a second or right cup 120B via a midsection or central gore 125. The first (left) and second (right) cups are contoured (e.g., convex on the exterior surface of the bra front portion, concave on the interior or user wearing surface of the bra front portion) to receive a portion of a respective user's breast (left or right) when the bra is worn by the user.

A plurality of peripheral side sections are provided radially outward from each cup (with the closest peripheral side sections being adjacent a corresponding cup). In particular, a first or upper attenuator 130A (also called a top pole) defines a section of the body oriented above the first cup 120A, along the cup's upper edge. The first attenuator 130A begins proximate the first or left lateral edge 135A of the gore 125 and extends generally horizontally, across the width of the first cup 120A and terminating proximate outer edge of the first strap 105A. As shown, the upper attenuator 130A tapers inward as it approaches the gore 125. A second or lateral attenuator 140A (also called a lateral pole) defines a section of the body 110 that is oriented behind the first cup 120A, along the side proximate the cup's outer edge. The lateral attenuator 140A extends generally vertically, from the upper attenuator 130A to a position below the cup horizontal centerline 142A. Optionally, a third or lower attenuator 145A may define a section of the body positioned along the first cup 120A, extending downward from the lateral attenuator 140A to a position proximate the cup vertical centerline. Alternatively, the lower attenuator may be omitted, with the cradle 155 extending up to the cup 120A (described in greater detail below).

Similarly, a first or upper attenuator 130B (also called a top pole) is oriented above the second cup 120B, along the cup's upper edge. The first attenuator 130B begins proximate the second or right lateral edge 135B of the gore 125, extending generally horizontally, across the width of the first cup 120B and terminating proximate outer edge of the second strap 105B. As shown, the upper attenuator 130B tapers inward as it approaches the gore 125. A second or lateral attenuator 140B (also called a lateral pole) is oriented behind the second cup 120B, along its side and proximate the cup's outer edge. The lateral attenuator 140B extends generally vertically, from the upper attenuator 130B to a position below the cup horizontal centerline 142B. Optionally, a third or lower attenuator 145B may be positioned along the second cup 120B, extending from the lateral attenuator 140B to a position proximate the cup vertical centerline. Alternatively, the lower attenuator may be omitted, with the cradle 155 extending up to the cup edge (described in greater detail below).

A neckline 150 defines a bridging section of the body 100 positioned above the cups 120A, 120B and gore 125 and spanning the bra front portion 110, extending from the outer edge of the first bra strap 105A to the outer edge of the second bra strap 105B. Similarly, the cradle or frame 155 defines the section of the body 100 oriented below the cups 120A, 120B that extends from a first or left wing 160A to a second or right wing 160B. Each wing defines a lateral section of the body, spanning the front 110 and rear bra 115 portions to transitioning to a back band 163 in the rear bra portion, proximate the combined strap 119. Each wing 160A, 160B forms the lateral sides of the body, being configured to define the armpit areas 165A, 165B of the bra.

In an embodiment, the bra 10 (or one or more sections) is a textile formed via knitting. Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops. In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the strands running continuously around the fabric. With a flat knitting machine, the fabric is produced in flat form, the strands/loops alternating back and forth across the fabric. In an embodiment, the bra is formed via flat knitting utilizing stitches including, but not limited to, a plain stitch; a rib stitch, a purl stitch; a missed or float stitch (to produce a float of yarn on the fabric's wrong side); and a tuck stitch (to create an open space in the fabric). The resulting textile includes an interior side (the technical back) and an exterior side (the technical face), each layer being formed of the same or varying strands and/or stitches. By way of example, the textile may be a single knit/jersey fabric, a double knit/jersey fabric, and/or a plated fabric (with yarns of different properties are disposed on the face and back). Further, the knitting machine can comprise a double bed knitting machine to facilitate continuous knitting of the separate layers that connect with each other at selected distances (measured by rows or courses as described herein) along the layers.

Utilizing knitting, the entire bra (or selected sections) may be configured as a single, one piece or unitary structure (i.e., it may possess a monolithic or unibody construction) to minimize the number of seams utilized in forming the final shape of the upper. Specifically, the bra 10 may be formed as a one-piece template, each template portion being integral with adjacent template portions. Accordingly, each section 105A, 105B, 120A, 120B, 125, 130A, 130B, 140A, 140B, 145A, 145B, 150, 155, 160A, 160B, 163 of the bra 10 may include a common strand interconnecting that section with adjacent sections (i.e., the common strand spans both sections). In addition, the transition between adjacent sections may be stitchless and seamless. By stitchless and/or seamless, it is meant that adjacent sections are continuous or integral with each other, including no edges that require joining by stitches, tape, adhesive, welding (fusing), etc.

Stated another way, when formed of unitary knit construction, the bra 10 may be formed as a one-piece element through a knitting process. That is, the knitting process substantially forms the various features and structures of bra 10 without the need for significant additional manufacturing steps or processes. A unitary knit construction may be used to form a bra having structures or elements that include one or more courses of yarn, strands, or other knit material that are joined such that the structures or elements include at least one course in common (i.e., sharing a common yarn) and/or include courses that are substantially continuous between each of the structures or elements.

The strands forming the knitted textile may be any natural or synthetic strands suitable for their described purpose (i.e., to form a knit upper). The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands may be heat sensitive strands such as flowable (fusible) strands and softening strands. Flowable strands are include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions but become irreversibly inflexible upon heating.

The strands may also include heat insensitive strands. Heat insensitive strands are not sensitive to the processing temperatures experienced by the upper (e.g., during formation and/or use). Accordingly, heat insensitive strands possess a softening, glass transition, or melting point value greater than that of any softening or melting strands present in the textile structure and/or greater than the temperature ranges specified above.

The strand further includes elastic strands and inelastic strands. Elastic strands are strands formed of elastomeric material. Elastic strands, by virtue of their composition alone, are capable of stretching under stress and recovery to its original size once the stress is released. Accordingly, elastic strands are utilized to provide a textile upper with stretch properties. An elastic strand is formed rubber or a synthetic polymer having properties of rubber. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane.

In contrast, an inelastic is formed of a non-elastomeric material. Accordingly, inelastic strands possess no inherent stretch and/or recovery properties by virtue of composition. Hard yarns are examples of inelastic strands. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

Advantages of a knit construction include stretch and recovery properties. The bra 10 can also define a plurality of zones that differ in one or more characteristics. In some embodiments, various zones possess varying stretching elasticity when subjected to a stretching force. These stretching and elasticity characteristics can be observed and measured in various ways. For example, the stretching and elasticity characteristics can be measured using the procedure set forth in ASTM D2594. By way of further example, the knit material forming a particular zone 10 is measured to determine the width or length of the material. A stretching force or load is then applied to stretch and elongate the material. The corresponding increase in width or length can then be calculated.

The difference in elasticity can be a result of one zone from yarns that are more elastic than the yarns knitted in another zone. Also, fusible yarns can be knitted and fused within one zone, while another zone can may contain a lesser amount or no fusible yarns.

Figure 2:
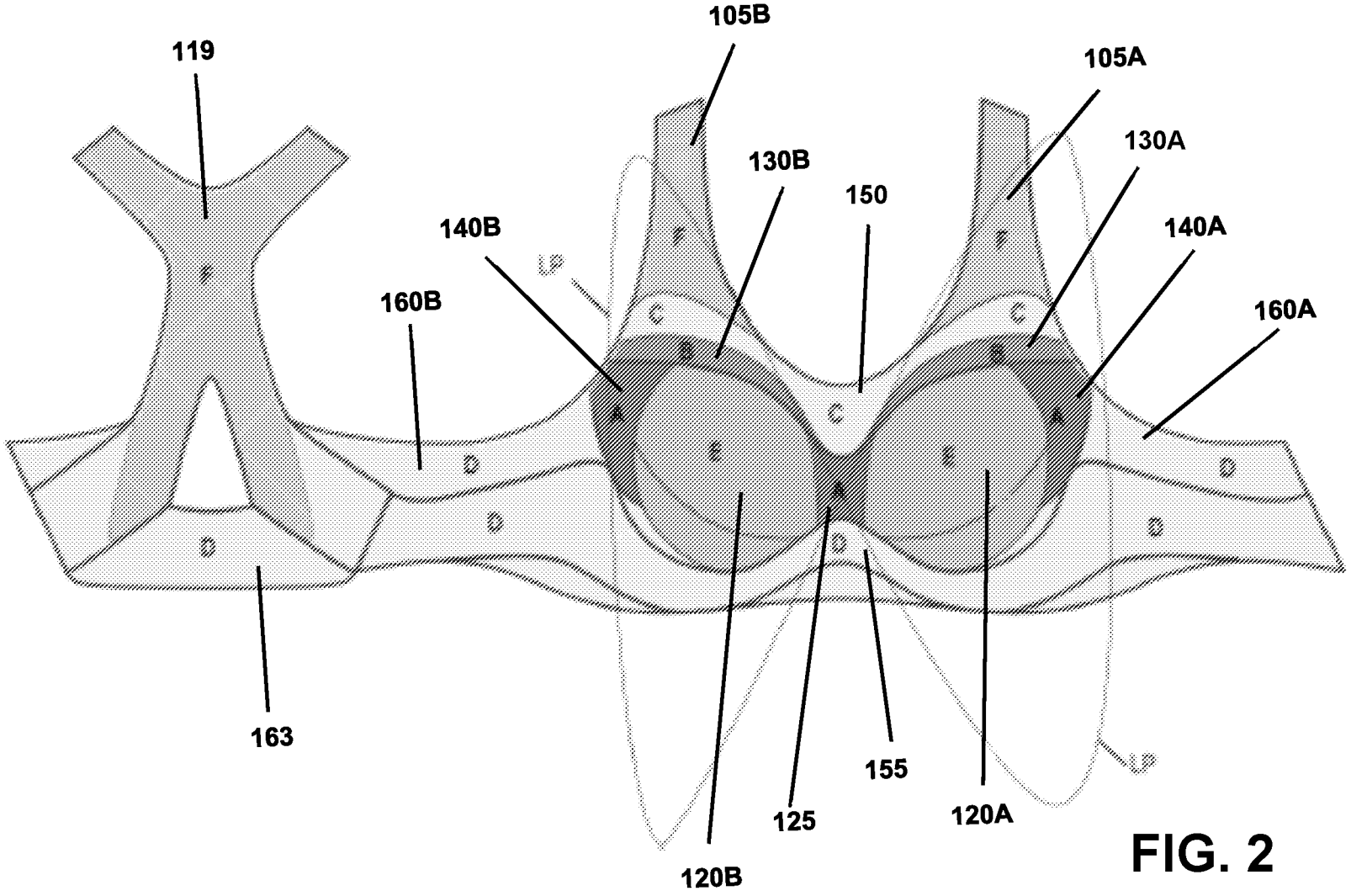
FIG. 2 is a view of the bra of FIG. 1A presented in a flattened configuration and showing different regions or zones of elastic modulus along portions of the bra in accordance with an embodiment of the invention.

In this manner, the construction of the knit bra 10 can be mapped with stretch zones that cooperate to drive breast kinematics during movement (e.g., during exercise such as jogging). Referring to FIG. 2, an exemplary schematic of modulus or stretch zones is provided. Using the stretch and recovery properties defined by industry standard ASTM D2594, the resiliency of the fabric in the length (wales) and/or width (courses) directions is selected to define segmented zones of stretch, positioned to constrain axial movement in some directions while permitting greater axial movement in other directions. Appropriately patterned, the stretch zones generate synchrony between breast motion and body motion. By way of specific example, the modulus zones are configured to drive breast motion in a lemniscate pattern LP, as shown in FIG. 2. A lemniscate is a curve with a characteristic shape, consisting of two loops that meet at a central point, similar to an infinity symbol and/or a number eight symbol.

In an embodiment, the modulus zones are those illustrated in FIG. 2. It is noted that modulus zones can also be mapped in any other desired manner depending upon a particular application. As illustrated, Zone A includes the gore 125 and the lateral attenuator 140A, 140B areas; Zone B includes the first 130A and second 130B attenuators; Zone C includes the neckline 150; Zone D includes the cradle or frame 155, the left wing 160A, the right wing 160B and the rear 163; Zone E includes each cup 120A, 120B; and Zone F includes the straps 105A, 105B, 119. The modulus of each zone (the degree of stretch) is selected to permit breast motion but limit its velocity and/or influence the direction of motion. Specifically, regarding stretch in the machine direction and, specifically, the machine width (also known as the garment length direction), Zone A possesses the lowest modulus, Zone B and Zone C possesses a higher modulus, and Zone D possesses a modulus higher than that of Zone B and Zone C. See Table I, below. As shown, the degree of stretch (machine width) in each of these zones falls between approximately 25% to approximately 35%. The cups—Zone E—provides the greatest degree of stretch, being over 80%. Finally, Zone F (the back and shoulder straps) possesses an intermediate stretch value of about 50%. In this configuration, the greatest degree of stretch or elongation is provided at the cup sections and the elasticity decreases in a direction extending radially outward from each cup section. It is further noted that the bra is formed such that its orientation as shown in FIG. 2 is in the machine length direction (i.e., the machine width direction is from strap to cradle of bra). However, the elastic moduli can be modified in any suitable manner for the various zones depending upon a particular application of use.

TABLE 1

ASTM D2594 (10 lbs) Stretch Values (% stretch)

| A | B | C | D | E | F | Garment Zone |
|---|---|---|---|---|---|---|
| 28.06 | 30.67 | 30.27 | 34.43 | 84.15 | 52.46 | Stretch Machine Width Direction |
| 37.23 | 25.99 | 48.29 | 55.85 | 129.81 | 47.83 | Stretch Machine Length Direction |

Figure 3A:
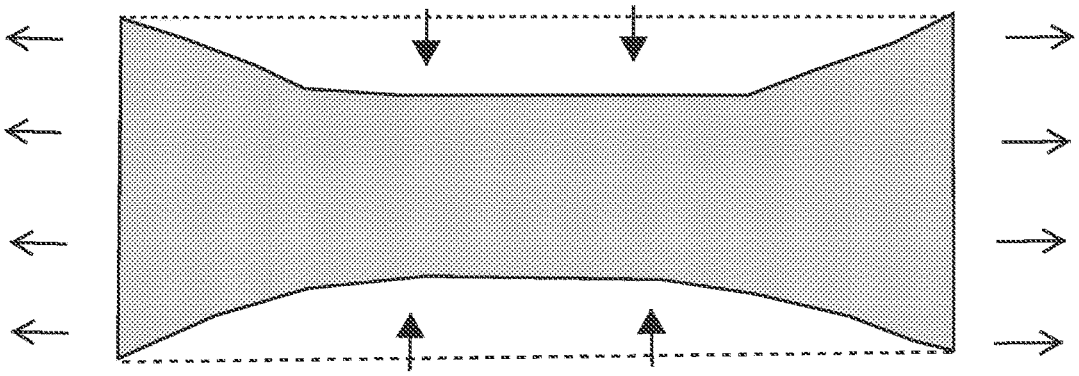
FIGS. 3A, 3B and 3C respectively illustrate schematic views of a portion of the bra in a loaded state with positive Poisson's ratio, in a loaded state with a negative Poisson's ratio, and in a loaded state with a neutral Poisson's ratio.
Figure 3B:
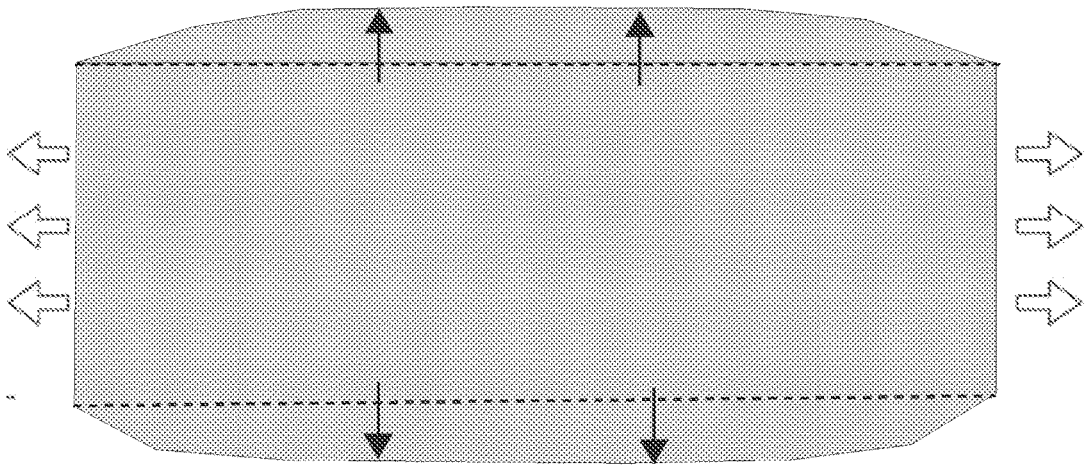
Figure 3C:
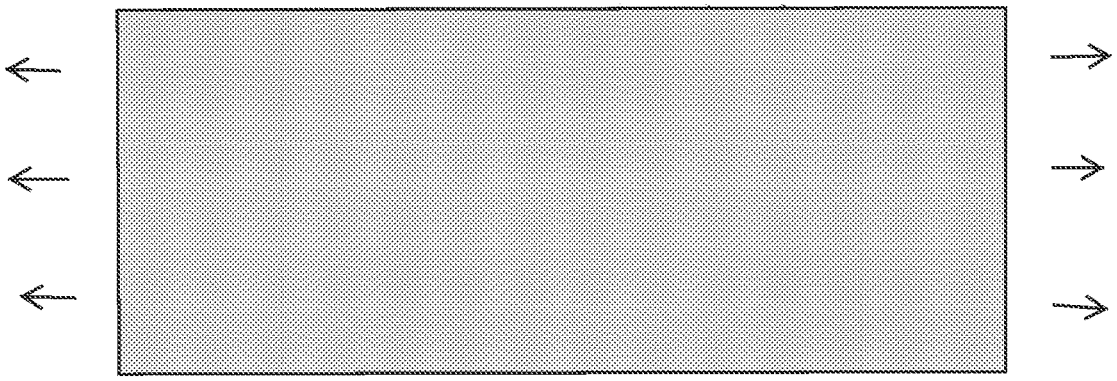

In addition, the Poisson ratio of the bra zones may be selected to improve fit, function or both. Poisson ratio measures the deformation in the material in a direction perpendicular to the direction of the applied force. Knit fabric normally possesses a strongly positive Poisson's ratio; consequently, under load, the fabric will contract in the dimension transverse to the load as shown in FIG. 3A. With an inventive knit construction, however, the fabric can be engineered to possess a lower Poisson's ratio and, as such, a different stretch pattern. Referring to FIG. 3B, knit fabric engineered to possess a strongly negative Poisson's ratio expands in the dimension transverse to the load. In other words, when stretched, the multilayered knit structure will move or expand in a direction generally orthogonal or perpendicular to the applied tension or stretching force. Finally, referring the FIG. 3C, knit fabric engineered with a near auxetic or slightly positive Poisson's ratio may possess a neutral pattern, exhibiting little to no contraction or expansion in the dimension transverse to the applied load (i.e., +/−5% expansion or contraction in direction transverse to load). Stated another way, the multilayered structure will expand in the load direction, but will substantially maintain the same dimension (i.e., will not contract) along the direction orthogonal to the applied tension or stretching force. For example, expansion of the knit structure in the wale direction of the first and second outer layers (and course direction of the intermediate layer) results in the dimension of the knit structure staying the same (i.e., does not contract, Poisson's ratio decreases but is generally neutral or slightly positive) or a corresponding expansion of the knit structure in the course direction of the outer layers and wale direction of the intermediate layer (negative Poisson's ratio). In other words, the knit fabric structure will exhibit near auxetic or auxetic properties when stretched in a dimension that corresponds with the direction of consecutive peaks extending along the corrugated shape of the intermediate layer.

In an embodiment, each cup 120A, 120B may be configured to possess a lower Poisson's ratio than the remainder of the bra 10. Specifically, each cup 120A, 120B may possess a negative Poisson's ratio or a near auxetic Poisson's ratio.

Figure 4:
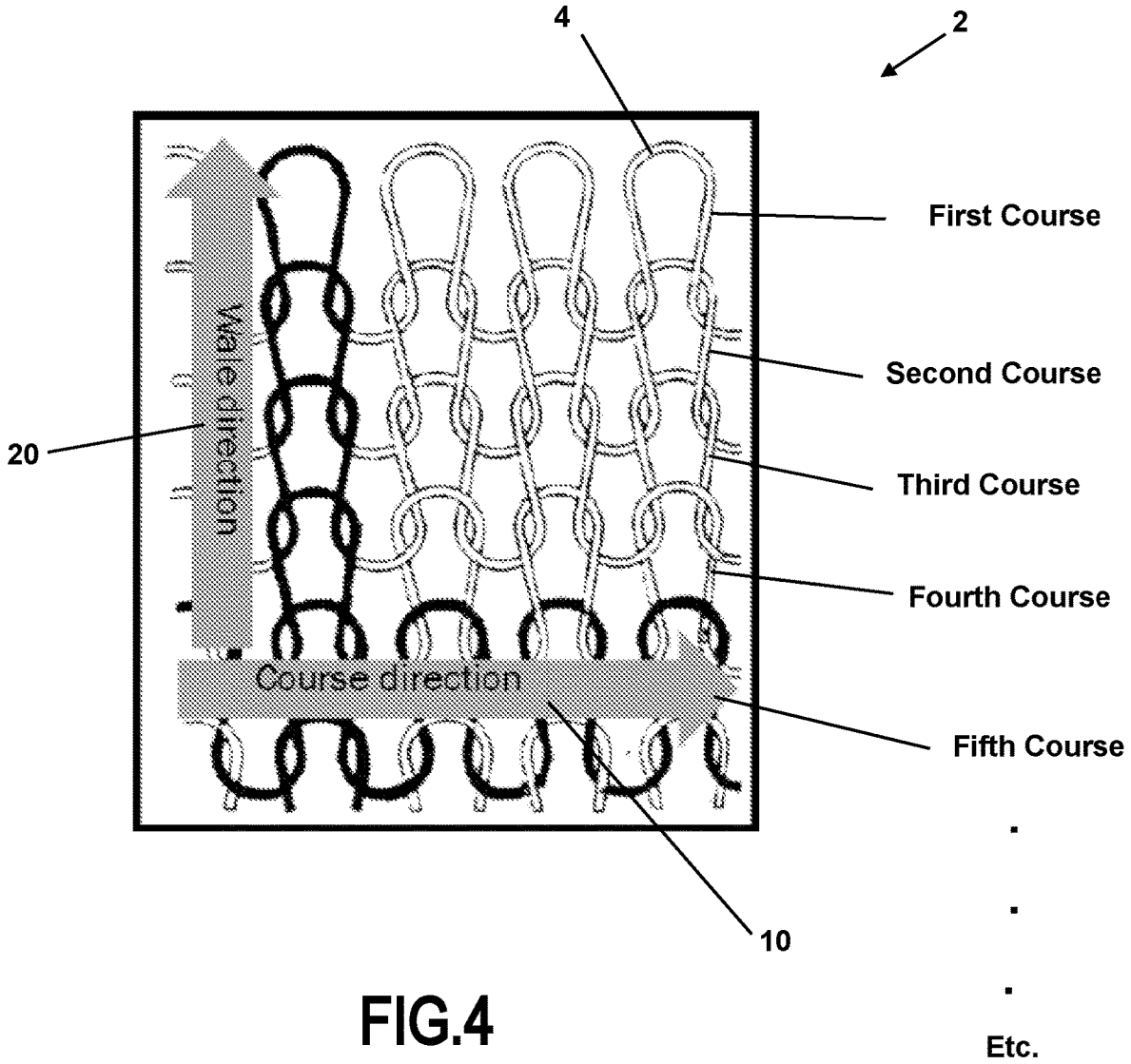
FIG. 4 depicts a view of a knit fabric structure showing rows of courses and wales.

The knitting process for forming the knit material comprises interlooping of one or more strands or yarns together to form layers, where the layers are further combined with each other in a manner as described herein. In general, knitting is the method of creating fabric by transforming continuous strands of yarn into a series of interlocking loops, where each row of such loops hangs from the one immediately preceding it. The basic element of a knit fabric structure is the loop intermeshed with the loops adjacent to it both sides and above and below it. An example embodiment of a single layer of knit fabric structure 2 is depicted in FIG. 4, where the structure 2 includes continuous strands of yarn 4 forming interconnected loops. Loops of a continuous strand are arranged along a row of the structure 2 in what is referred to as the course direction 10 of the knit structure, while the opposing or orthogonal direction of the knit structure to the course direction is referred to as the wale direction 20. Accordingly, courses (i.e., rows of interconnected loops arranged in the course direction) of the knit structure 2 are defined along the wale direction 20 (e.g., first course, second course, third course, fourth course, fifth course, etc.).

Forming a fabric structure via a knitting process can be performed in different ways, including warp knitting and weft knitting. In warp knitting, the yarns generally run lengthwise in the fabric (e.g., tricot, milanese, and raschel knitting). In weft knitting, one continuous thread runs crosswise in the fabric making all of the loops in one course. The knit structure 2 depicted in FIG. 4 is an example of weft knitting. Weft knitting includes both circular knitting and flat knitting. In circular knitting, the fabric is produced on the knitting machine in the form of a tube, with the threads running continuously around the fabric. In flat knitting, the fabric is produced on the knitting machine in flat form, the threads alternating back and forth across the fabric. By way of example, a knit structure can be knitted using a double bed flat knit machine such as a programmable CMS 530 H or CMS 730 S flat knitting machine from H. Stoll GmbH & Co. Further, the knitting machine can comprise a double bed knitting machine to facilitate continuous knitting of the separate layers that connect with each other at selected distances (measured by rows or courses as described herein) along the layers. The knit structure formed herein can also comprise jersey knit layers of fabric material. The multi-layered knit structure described herein can be formed via any suitable knitting process that facilitates the formation of a plurality of interconnected layers having properties as described herein that impart useful Poisson ratio features (e.g., auxetic and/or near auxetic properties) to the knit structure.

In example embodiments of the multi-layer knit structure described herein, the knit structure is formed via a weft knitting process (e.g., circular knit or flat knit) where each layer is knit/constructed at about the same or similar time with the other layers and/or during the same knitting process, with layers being connected with each other at selected intervals of courses of each knit layer as described herein. Each knit layer can comprise a jersey knit fabric material, where the intermediate knit layer has different elastic properties as the outer knit layers as described herein.

It is noted that, when describing the layers forming the knit structure, the term "yarns" is used. However, it is noted that the layers of the knit structure can be formed with strands, fibers, filaments and/or yarns. The term strand includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). In a preferred embodiment a strand is a yarn (a continuous strand of textile fibers, filaments, or material in a form suitable for knitting, weaving, or otherwise intertwining to form a textile fabric). A yarn may include a number of fibers twisted together (spun yarn); a number of filaments laid together without twist (a zero-twist yarn); a number of filaments laid together with a degree of twist; and a single filament with or without twist (a monofilament).

Figure 5:
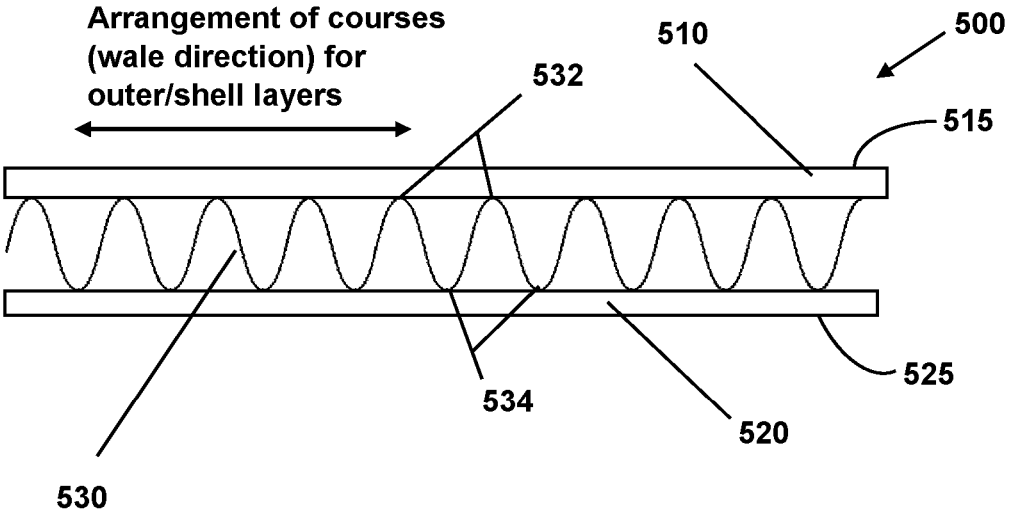
FIG. 5 is a schematic view in cross-section (taken along the course direction of the middle or interior layer) of an example embodiment of a knit structure for the bra comprising a plurality of connected layers having auxetic properties as described herein.
Figure 6A:
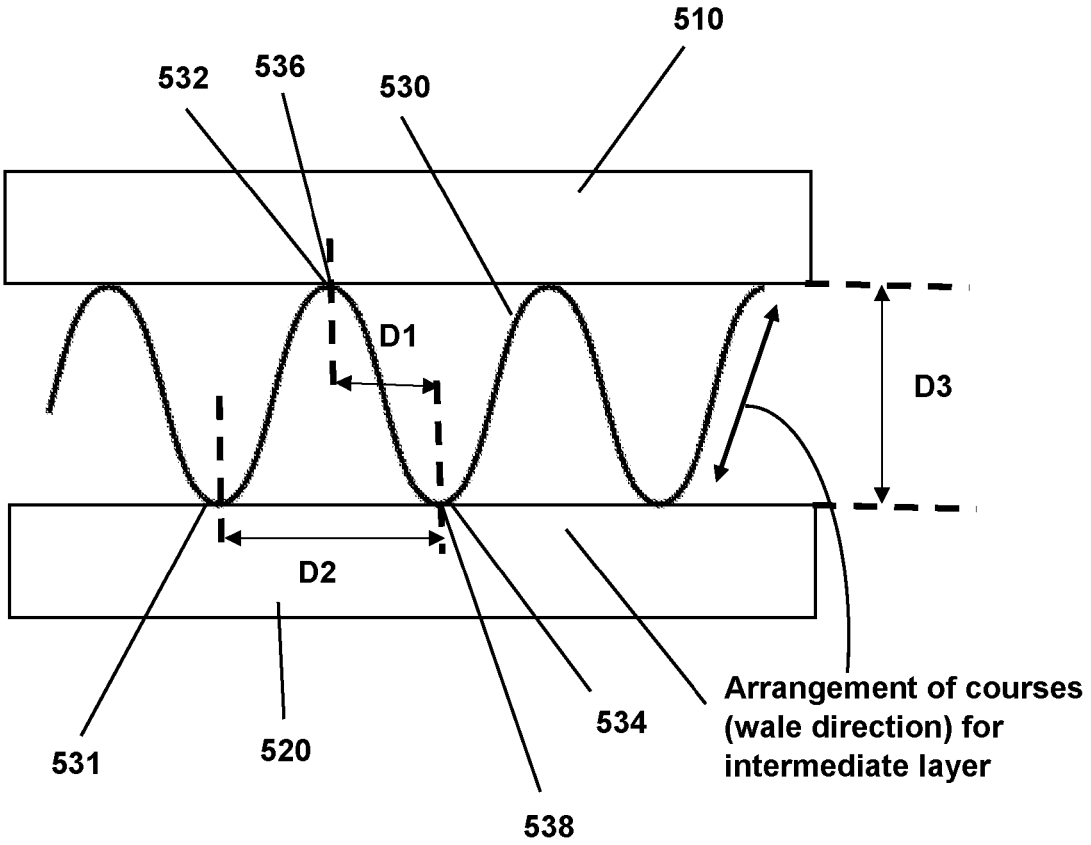
FIG. 6A is an enlarged view of a portion of the knit structure of FIG. 5.
Figure 6B:
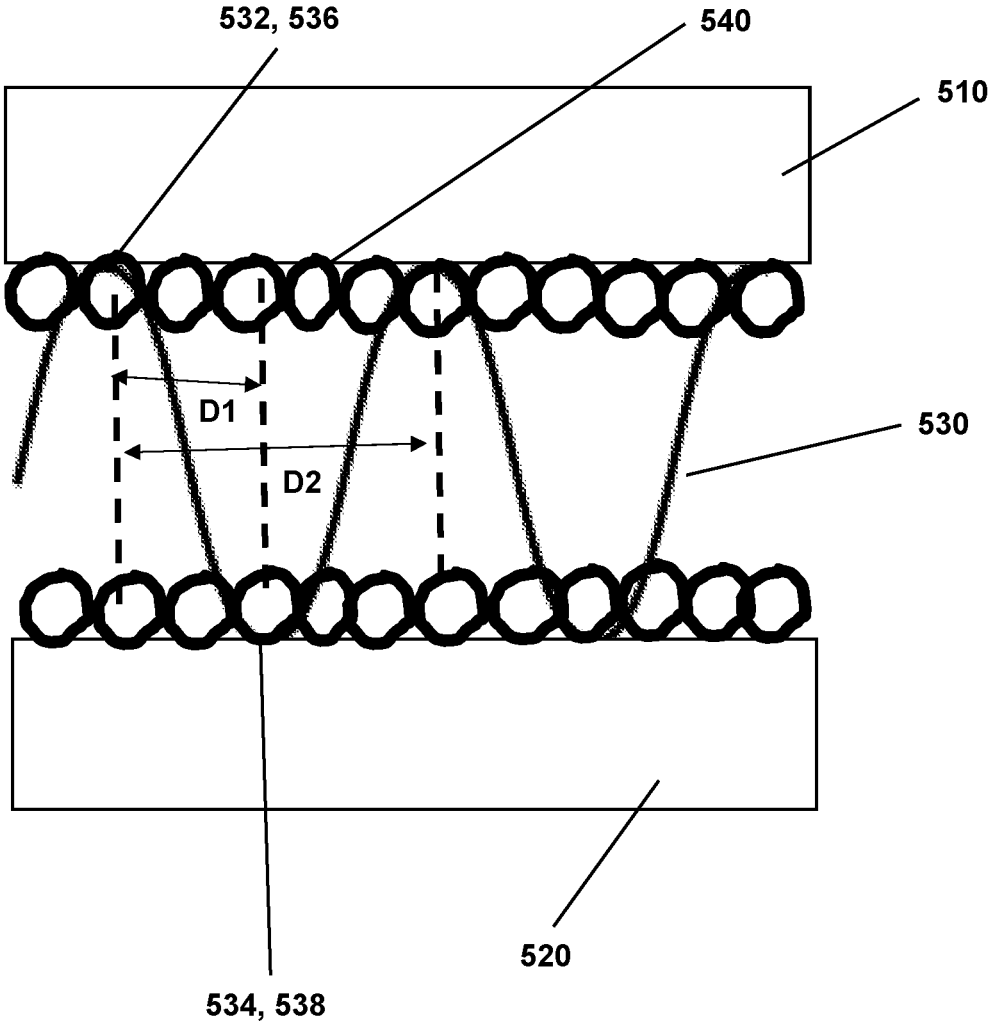
FIG. 6B is an enlarged view of FIG. 5 (i.e., a further enlarged view of FIG. 5), in which knit courses are schematically depicted along the wale direction for each of the first and second outer knit layers of the structure.

Referring to the example embodiment of FIGS. 5, 6A and 6B, a knit structure 500 includes a plurality of jersey knit layers (e.g., 3 layers) connected with each other, where each layer is formed of strands or yarns during the knitting process so as to be separated, individual or distinct from the other layers, where two or more layers are interconnected with each other at certain locations along the knit structure as a result of the knitting process.

The knit structure 500 includes a first shell or outer layer 510 that includes a first surface 515 defining an exposed side of the knit structure, a second shell or outer layer 520 that includes a second surface 525 defining an exposed side of the knit structure that opposes the first surface 515, and a resilient middle or intermediate layer 530 that extends between and interconnects with the first and second outer layers. The resilient intermediate layer 530 has an undulating or corrugated shape that generally defines a sinusoidal or wavy pattern in which the intermediate layer 530 connects in an alternating manner with the first outer layer 510 and the second outer layer 520 at each crest or peak (e.g., at the amplitude) along the corrugated surface of the intermediate layer. In other words, the outer layers connect with the intermediate layer at opposing peaks (i.e., peaks oriented in opposing directions) of the intermediate layer. For example, as shown in FIG. 5, consecutive peaks of the intermediate layer 530 are oriented in opposing directions such that the peaks comprise a set of first peaks 532 oriented in a first direction and a set of second peaks 534 oriented in a second direction that opposes the first direction, the first peaks 532 of the intermediate layer 530 connect with the first knit layer 510 and the second peaks 534 of the intermediate layer 530 connect with the second knit layer 520.

While the knit material structure 500 depicted in the figures comprises a three-layer structure (first and second outer or shell layers, and middle or intermediate layer), it is noted that the knit material structure can also include additional layers (e.g., layers between the first and second outer layers and/or further layers coupled to either or both of the first and second outer layers at the exterior surface of the outer layers).

The first and second outer layers 510, 520 can be formed of the same or similar materials. In an example embodiment, the first and second outer layers are identical in how they are formed and in relation to the yarns used to form the outer layers (e.g., with the first and second outer layers having the same number of courses in general alignment with each other when connected with the intermediate layer). Each outer layer can be formed with yarns that are non-elastic or harder/less elastic than yarns forming the intermediate layer 530. Non-elastic strands possess no inherent stretch and/or recovery properties by virtue of composition. Alternatively, each outer layer can be formed with yarns having the same or similar elasticity as the strands forming the intermediate layer. Some non-limiting examples of yarns that can be used to form the first and second outer layers include cellulosic fibers (e.g., cotton, bamboo) and protein fibers (e.g., wool, silk, and soybean), polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof. The first and second outer layers can also be formed of one or more elastic materials that can be of the same or similar types as those used to form the intermediate layer (as described herein).

The intermediate layer 530 is formed with yarns that are elastic and have at least the same elasticity or greater elasticity in relation to the yarns that form the first and second outer layers 510, 520. By way of example, elastic strands or yarns forming the intermediate layer include an elastomeric material (e.g., a 100% elastic material). Elastic strands or yarns, by virtue of their composition alone, are capable of stretching under stress and recovering to an original size once the stress is released. Accordingly, elastic strands or yarns are utilized to provide a textile with stretch properties. An elastic strand or yarn is formed of rubber or a synthetic polymer having properties of rubber. A specific example of an elastomeric material suitable for forming an elastic strand or yarn is elastane, an elastomeric polyester-polyurethane copolymer (e.g., an elastane yarn commercially available under the tradename SPANDEX). The elastomeric yarns used to form the intermediate layer can also comprise covered yarns, such as a single covered yarn or a double covered yarn (DCY), where an elastomeric strand forms the core of single or double covered yarns and is thus covered (e.g., helically wound) by one or more non-elastic strands.

In an example embodiment, the first and second outer knit layers 510, 520 are formed of polyester yarns, while the intermediate knit layer 530 is formed of double covered yarns comprising polyester and elastane (i.e., polyester strands wrapped around elastane strands).

The first and second outer layers and the intermediate layer are each individual, separate knit layers that are formed together in a single knitting process, where the intermediate layer couples the first and second outer layers together at the connections or stitch locations (i.e., at the peaks of the intermediate layer). The connections or stitch locations between the intermediate layer and each of the first and second outer layers can be formed in a suitable manner, where one or more yarns formed along a course of the intermediate layer wrap around or interconnect with one or more yarns formed along a course of the first and/or second outer layer.

As indicated in FIG. 5 and further in FIGS. 6A and 6B, the arrangement of rows or courses (i.e., wale direction) of the knit material for each of the first and second shell or outer layers 510, 520 extends in the same direction as the undulating or corrugated pattern formed by the intermediate layer 530. For example, courses 540 are schematically depicted along the surfaces of the outer layers 510, 520 in FIG. 6B. In contrast, the arrangement of courses (i.e., wale direction) of the knit material for the intermediate layer 530 is transverse (e.g., orthogonal) the arrangement of courses (wale direction) of the knit material for each of the first and second outer layers (see FIG. 6A showing wale direction for the intermediate layer).

Referring to FIGS. 6A and 6B, the distance D1 between two adjacent and opposing peaks 532, 534 of the corrugated intermediate layer 530 defines a distance or course length (i.e., number of courses 540) from a connection or stitch 536 between the intermediate layer and the first outer layer 510 and a closest connection or stitch 538 between the intermediate layer and the second outer layer 520. The distance D1 between such consecutive alternating connections or stitch locations (where the intermediate layer couples together the first and second outer layers) can be defined by a number of rows or courses 540 along the first and second outer layers. In example embodiments, the distance or course length D1 is from about 3 courses to about 6 courses measured along each of the first and second outer layers. In the example embodiment of FIGS. 6A and 6B, the consecutive connections or stitch locations between the intermediate layer 530 and each of the first and second outer layers (e.g., distance between consecutive stitches 536, 538 for the second outer layer 520) is represented by distance or course length D2. The distance or course length D2 for consecutive stitch locations along the same outer layer can be from about 6 courses to about 12 courses measured along each of the first and second outer layers. In example embodiments (such as shown in FIGS. 5, 6A and 6B), each distance or course length D1 between consecutive alternating layer stitch locations is the same, and this also results in the distance D2 between consecutive stitch locations along the same outer layer being the same. In alternative embodiments, the distances/course lengths D1 and D2 can differ between different pairs of consecutive alternating layer stitches and between different pairs of consecutive stitches along the same layer.

As shown in FIG. 6A, a distance/course length D3 between consecutive connections or stitches along the intermediate layer 530 can be defined by number of courses between consecutive stitches along the intermediate layer. The distance/course length D3 can further define a height of the corrugated intermediate layer, or a distance between alternating peaks (e.g., peak-to-peak amplitude). The distance/course length D3 can be at least 3 rows or courses along the intermediate layer, e.g., from about 4 courses to about 8 courses along the intermediate layer).

As previously noted, the distances/course lengths D1, D2 and D3 are defined in terms of rows or courses along the outer layers or the intermediate layer. Another manner of measuring the distance is based upon a measurement of the actual distance (e.g., in metric length) of the distance between two consecutive stitches. However, it is noted that the Poisson (auxetic or near auxetic) effect achieved for the multi-layered knit structure as described herein is based upon selection of course spacing between the knit layers instead of selection of specific stitch lengths (choosing lengths between stitches).

The intermediate layer 530 can be formed as a two way stretch fabric layer or a four way stretch fabric layer. In particular, the intermediate layer can possess an elongation (stretch) value that is the same or can vary in the course direction compared with the wale direction of the intermediate layer. An elongation value (also referred to as a stretch value) refers to an amount of elongation of a yarn or material that can occur prior to shearing or breaking of the yarn or material, where the elongation of the yarn or material is represented by a dimension (length or width) that is defined with the formula: [(elongated dimension−original dimension)/(original dimension)]×100. Recovery (elastic recovery or elasticity) is the ability of a yarn or material under load to recover its original size or near original size and shape immediately after removal of the stress that causes deformation. In an example embodiment, the intermediate layer can have a dominant degree of stretch or elongation in the course direction (i.e., direction that opposes the wale direction of the first and second outer layers, or along the corrugation as shown in FIG. 5). In other words, the degree of stretch or elongation of the intermediate layer can be greater in the course direction in comparison to the wale direction of the intermediate layer. This can be due to the orientation of the elastomeric yarns and/or the corrugated orientation of the intermediate layer. For example, the intermediate layer can have an elongation value in the course direction (i.e., direction of the sinusoidal or corrugated pattern as shown in FIG. 5) of at least about 50%, e.g., from about 75% to about 250% (ASTM D4964-96 (R2016)). The intermediate layer can further have an elongation value in the wale direction of at least about 24%, e.g., from about 30% to about 70%. Alternatively, the intermediate layer can have the same or similar elongation values in the course and wale directions.

The first and second outer layers can possess an elongation value that are the same or similar to each other and are less than the elongation value of the intermediate layer along each of the course and wale directions of the first and second outer layers. The first and second outer layers can also have the same or different elongation values along their course and wale directions. In an example embodiment, each of the first and second outer layers can possess an elongation value along the wale direction for each layer of less than 100% (e.g., no greater than about 50%).

The elongation properties of the layers combined with the corrugation configuration of the intermediate layer and the noted distances/course lengths between alternating connection points between the intermediate layer and the first and second outer layers provides unique stretch and recovery properties for the overall knitted fabric structure 500. In particular, a dynamic textile is formed that is capable of repeated stretching under load and recovery to original or near original size/lengths upon removal of the load. In other words, the stretch properties of the intermediate layer, combined with its corrugated shape and connection points (distances/course lengths) between the first and second outer layers facilitate a certain amount of overall stretch for the multilayered fabric material under load and, upon removal of the load, further drives the entire fabric material back to its normal, unstretched state.

Figure 7A:
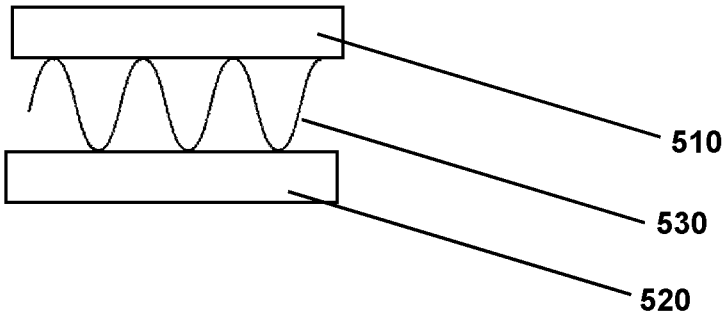
FIG. 7A is a schematic view of a portion of the knit structure of FIG. 5 in normal, unloaded or unstretched configuration.
Figure 7B:
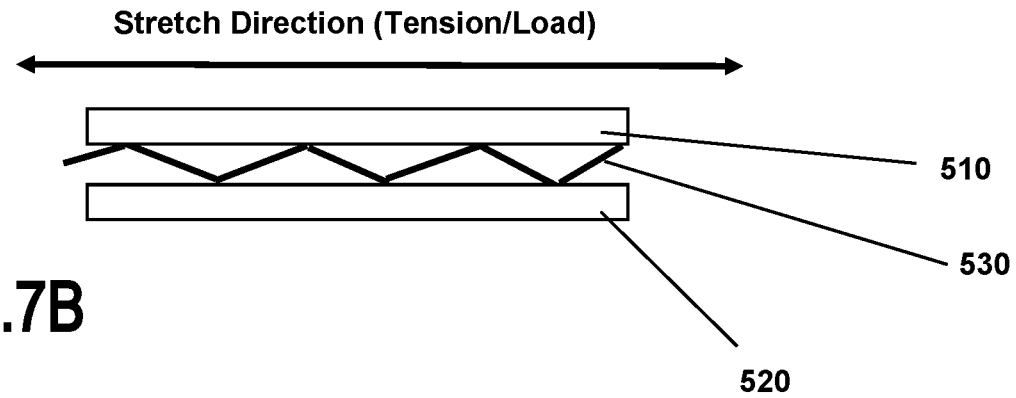
FIG. 7B illustrates the knit structure of FIG. 7A under a first degree of tension or load.
Figure 7C:
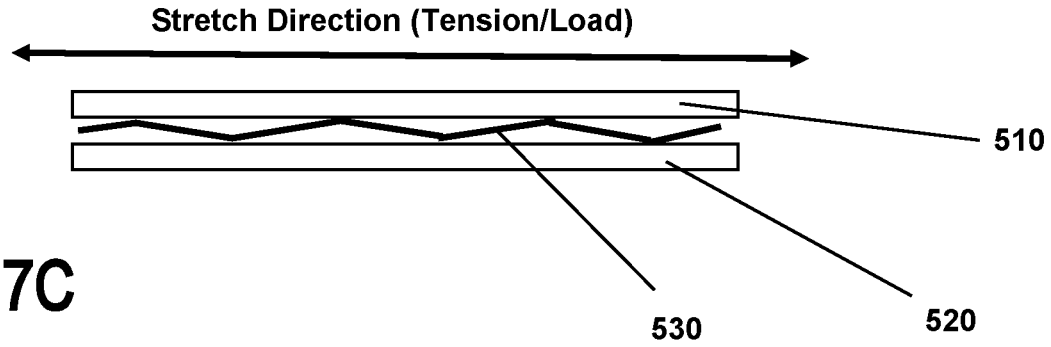
FIG. 7C illustrates the knit structure of FIG. 7A under a further degree of tension or load (e.g., a maximum or "lock out" tension).
Figure 7D:
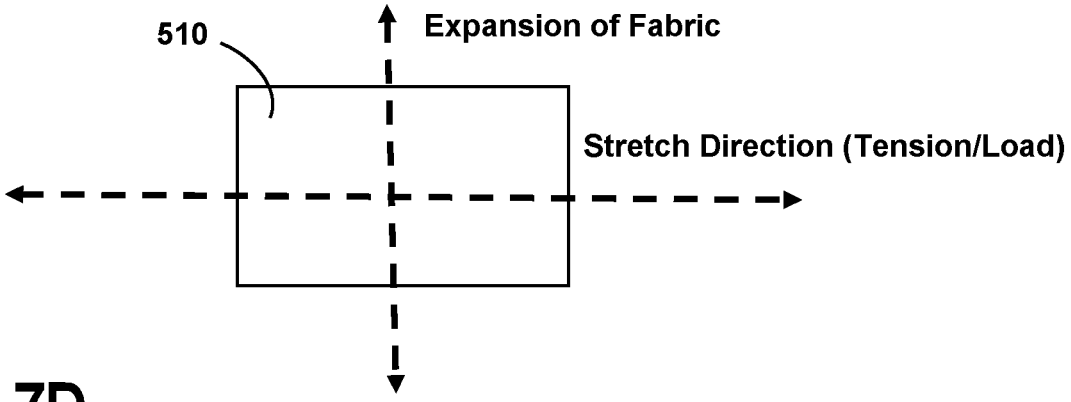
FIG. 7D depicts a view in plan of an exterior surface of the knit structure of FIG. 7C, showing surface area expansion of the knit structure in a dimension transverse the direction of stretch (tension) being applied to the knit structure.

Referring to FIGS. 7A, 7B and 7C, a schematic of an example embodiment is depicted showing stretching of the multilayered knit fabric structure and how the corrugated intermediate layer 530 facilitates stretching along its course direction and along the wale directions of the first and second outer layers 510, 520. Referring to FIG. 7A, a portion of the knit fabric structure 500 is depicted in which the structure is in a relaxed state (i.e., not subject to any force or load). In FIG. 7B, a load is applied to the fabric structure 500 causing a stretch in the wale directions of the first and second outer layers 510, 520 and a corresponding stretch along the course direction of the intermediate layer 530 (due to the connections between the intermediate layer and the outer layers). The stretch direction is indicated by the double arrows in FIGS. 7B and 7C. As shown in FIG. 7B, as the fabric structure is stretched, the corrugation of the intermediate layer 530 (i.e., the amplitude of the corrugated loops) starts to shorten or decrease in dimension. Referring to FIGS. 7C and 7D, the fabric structure 500 continues to stretch, elongating the outer layers and the intermediate layer further resulting in further reduction in dimension of the corrugations (amplitude of loops) for the intermediate layer. This further decreases somewhat the distance between the first and second outer layers (i.e., the fabric structure slightly decreases in thickness).

At some point (e.g., as shown in FIG. 7C), the corrugation of the intermediate layer 530 flattens to its full extent, resulting in a "lock out" position or limit in stretch of the fabric structure 500. At this "lock out" position, the fabric structure is prevented or substantially limited in any further stretch capability in the wale direction of the outer layers 510, 520. When the tension or load on the fabric structure is released, the fabric structure 500 "snaps back" or recovers to its original (or substantially original) dimensions including the original (relaxed) lengths along the wale direction of the first and second outer layers 510, 520 and the course direction of the intermediate layer 530 (e.g., the orientation as shown in FIG. 7A). With this configuration, the fabric structure 500 provides a dynamic textile that repeatedly stretches under load and recovers upon removal of the load.

Figure 8A:
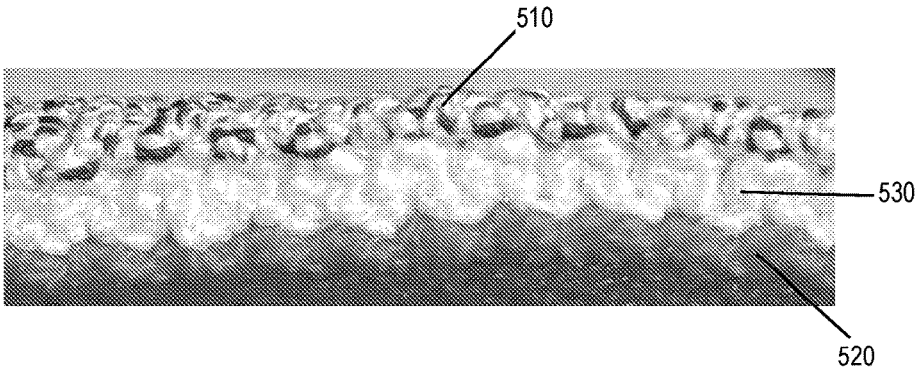
FIG. 8A is a cross sectional view of a fabric portion of the bra in accordance with an embodiment of the invention, shown in an unloaded state.
Figure 8B:
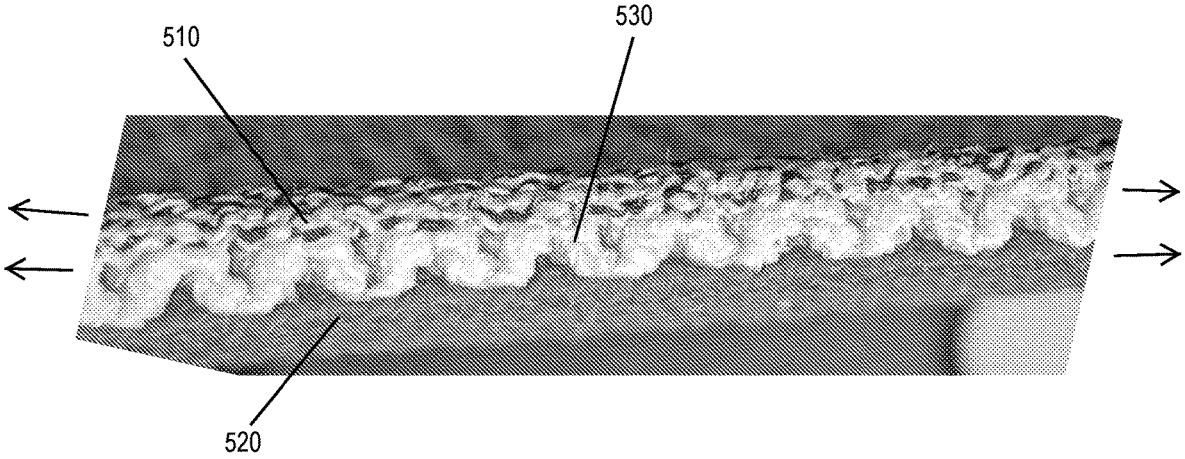
FIG. 8B is a cross sectional view of the fabric of FIG. 8A, shown in a state under load.

Similarly, referring to FIGS. 8A and 8B, the fabric moves from an unloaded position (no tensile load applied), in which the intermediate corrugations are collapsed (e.g., in contact with each other), to a loaded position upon application of a tensile load (indicated by arrows). As shown, the fabric expands, and the distance/spacing between the corrugations/undulations of the intermediate layer increases.

With this configuration, in an embodiment, the bra 10 is provided with different degrees of elasticity at different locations along the bra as described herein, thus resulting in a gradient in modulus of elasticity or different stretch or elastic modulus zones at certain areas along the surface of the bra. In particular, the bra is provided with different areas or zones of elasticity starting generally centrally along the front portion 110 of the bra 10, at the left cup section 120A and the right cup section 120B, with elastic modulus zones changing in a radially outward direction from the centrally located cup sections such that the elastic modulus increases (i.e., increase in stiffness) at areal locations or zones along the front portion 110 that are at greater radial distances from the left and right cup sections.

The different areas or zones of elasticity can be provided at different areas of the bra based upon fabric formation techniques and/or types of filaments or yarns utilized in the formation of the fabric material forming the bra including. For example, the fabric can be formed with one or more different types of filaments or yarns utilizing a knit process, a woven process, a nonwoven process, an embroidery process and/or any combinations thereof.

The fabric material that forms portions of the bra as described herein can be formed to create different elastic modulus zones along a flat knit in a number of different ways based upon a desired layout and gradient in elastic modulus between zones. For example, different knit stitch orientations and/or combinations of different types of filaments or yarns can be provided at different areas or designated zones of the fabric during knitting (or other formation) process which in turn can yield varying degrees of stretch or elastic modulus at such zones of the formed fabric. In particular, a flat knitting process can provide targeted filament or yarn placement and knit constructions in specific areas or zones of the bra based on performance requirements, thus creating different zones of elastic modulus in the fabric material and mapped along locations of the bra as described herein.

In example embodiments, fabric areas or zones of greater stretch/elasticity can be formed of elastomeric filaments or yarns or a blend of elastomeric and non-elastomeric yarns having a greater number of elastomeric yarns in relation to other fabric areas or zones having fewer or no elastomeric yarns and are less elastic and have a greater elastic modulus. For example, elastic/stretch zones at the left and right cup sections for the front portion of the bra can be formed of a first percentage of elastane yarns (e.g., greater than 50%), whereas elastic/stretch zones located at a greater radial distance from the central region of the front portion and having a second percentage of elastane yarns (e.g., less than 50% or no elastane yarns) that is less than the first percentage.

The locations of the zones of varying stretch degree or elastic modulus, with greater stiffness/less elasticity in fabric material being provided in radial outwardly extending areas of the front region of the bra from the central cup section regions, provides an effective dampening of breast movements (e.g., a progressive slowing or limiting of breast tissue movement in a radial outwardly expanding direction from each breast cup section) during physical activities in which the user's body is moving in vertical and/or side-to-side orientations.

In particular, when considering how effective a bra is in controlling breast movements during physical activities, a measurement of breast body synchrony can be determined by testing of the bra worn on a user's body during such physical activities. For example, in a running activity (in which the user's strides result in a vertical displacement of the user from a support surface), a value for breast body synchrony can be determined as the time difference between a breast of the user reaching its highest point and the body (at the sternal notch) reaching its highest point at each stride of the user. A positive value indicates that the breast has reached its highest point after the body, while a negative value indicates that the breast has reached its highest point before the body. In addition, a vertical breast velocity can be determined as the peak speed of the breast tissue relative to the user's torso during each stride of the user, and (using a suitable algorithm) a determination can be made regarding how far the breast tissue has moved out of sync in relation to the torso at one or more strides. In comparing a sinusoidal curve representing the user's vertical displacement during strides and a sinusoidal curve representing breast tissue movements in the same timeframe as the user strides, the difference in phase angle between the two sinusoidal curves provides an indication of how close or out of phase the breast tissue movement is with the user's strides.

The LP pattern depicted in FIG. 2 shows a symmetry in how the bra limits and controls the movement of each breast in the same or similar pattern during movements of the body. The regions with different zones of elastic modulus can achieve an effective dampening that results in breast tissue movements that are very close in phase and thus substantially synchronous with the user's strides when running or engaging in other activities resulting in vertical displacements of the user's body in relation to a support surface.

As previously noted herein, the cup sections and/or portions of the brat can be formed of a fabric material that imparts a negative, neutral, or even positive Poisson's ratio to the material structure. As further noted herein, properties can be imparted into the fabric material at one or more zones having auxetic properties, such as forming a fabric material as described herein and depicted in FIGS. 5-8. Fabric materials for the bra can also be formed with other suitable auxetic-like structures and/or auxetic shapes in the fabric material.

Auxetic structures or shapes can be formed in the fabric material in any suitable manner, where the auxetic shapes can be formed as reentrant polygonal shapes. A reentrant polygonal shape has one or more reentrant angles, where a reentrant angle is an internal angle of the polygon that is greater than 180°. Reentrant auxetic shapes can have hinge-like features (e.g., at the reentrant angle locations of the auxetic shapes) that can cause an expansion or compression of the composite material or layer upon which the auxetic shape is formed in a direction orthogonal or perpendicular to a direction of corresponding expansion or compression of the composite material.

In an example embodiment, auxetic shapes can be formed in a laminate layer that couples with a knit fabric layer to form a composite material so as to impart auxetic properties to the composite material (e.g., as described in U.S. patent application Ser. No. 15/347,589, the subject matter of which is incorporated herein by reference in its entirety). In another example embodiment, auxetic shapes can be formed via a stitching pattern that combines two or more fabric layers together forming a composite material so as to impart auxetic properties to the composite material (e.g., as described in U.S. patent application Ser. No. 17/129,335, the subject matter of which is incorporated herein by reference in its entirety). In a further example embodiment, a fabric material used for the Zone A regions of the bra can be formed so as to have a negative or neutral Poisson's ratio and/or auxetic properties in a multilayered knit structure without having to provide auxetic shaped structures within the multilayered knit structure (e.g., as previously described herein and depicted in FIGS. 5-8). Any other suitable fabric material structure can also be provided that imparts a negative Poisson's ratio/auxetic properties to the regions of the bra that define each Zone A.

Providing a negative or neutral Poisson's ratio and/or auxetic properties to the regions of the bra enhances the stretch/elastic capabilities in such regions and can further enhance the comfort to the user when the bra is worn. In particular, providing such properties to the breast cup sections of the bra allows these sections to conform around complex curves of the breasts and ensure a suitable fitting between the bra and the breasts for varying breast shapes (e.g., asymmetrical breast shapes).

A further enhancing feature of the bra material that can be provided is incorporating certain filaments or yarns within the fabric at portions of the bra that enhance or provide a cooling effect to the user's skin when the bra is worn, particularly in typically high heat zone areas of the bra such as in the left and right cup sections and/or the back region/back panel of the bra. One type of filament or yarn that can be implemented within the fabric at such locations of the bra comprises expanded polytetrfluoroethylene (ePTFE). Yarns formed of this material can provide significant cooling properties when implemented in the bra so as to be close or even in contact with the user's skin when the bra is worn. For example, a bra that incorporates filaments or yarns including ePTFE can impart a cooling sensation to the user during an athletic activity. Outer surface areas of the fabric forming the bra can include high density/high concentrations of ePTFE yarns that are located in close contact with the user's skin.

Thus, the bra with regions or zones having different stretch/elongation and different elastic modulus properties as described herein provides a zonal dampening effect to support more harmonized, synchronous movement of the user's breasts with the strides or other movements of the user during exercises and athletic activities. For example, the flat knit areas or regions along the front portion of the bra and varying elastic modulus values provide a progressive slowing of breast movements (e.g., vertical breast movements) so as to correspond with the movements of the user and further enhance breast support during use of the bra. The seamless construction that can be provided for the bra (e.g., when formed via flat knitting) also renders the bra more comfortable and less irritating when worn, and providing cooling filaments or yarns in the bra (e.g., ePTFE yarns) impart a cooling effect or sensation to the user's skin during use of the bra. Further still, providing bra cup sections with negative Poisson's ratio/auxetic properties enhances the fit of the cup sections with the user's breasts and accounts for varying breast shapes.

It is intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration.

What is claimed:

1. An athletic bra comprising:

a front portion and a rear portion, the front portion comprising a plurality of sections that form regions having different degrees of elasticity, the sections including a first cup section and a second cup section located at a central area of the front portion, wherein the sections of the front portion are oriented such that a gradient in elasticity is imparted along the front portion between the plurality of sections, and at least one of the sections comprises a knit section comprising a first outer layer, a second outer layer, and an intermediate layer disposed between and coupling together the first and second outer layers.

2. The athletic bra of claim 1, wherein the plurality of sections further comprises a plurality of peripheral sections that surround and are adjacent with one of the first and second cup sections.

3. The athletic bra of claim 2, wherein each of the first cup section and the second cup section has a degree of elasticity that is greater than any of the sections that surround and are adjacent with the one of the first and second cup sections.

4. The athletic bra of claim 3, wherein the plurality of sections that surround and are adjacent with one of the first and second cup sections includes a midsection disposed between the first and second cup sections, a first peripheral side section disposed along a side portion of the first cup section, and a second peripheral side section disposed along a side portion of the second cup section.

5. The athletic bra of claim 4, wherein the midsection, the first peripheral side section and the second peripheral side section have the same degree of elasticity.

6. The athletic bra of claim 3, wherein the plurality of sections that surround and are adjacent with one of the first and second cup sections includes a bridging section disposed above and extending between the first and second cup sections, and a cradle section disposed below and extending between the first and second cup sections.

7. The athletic bra of claim 1, wherein the intermediate layer has a corrugated shape that defines a plurality of peaks that that extend along a direction of the intermediate layer such that each peak extends in an opposing direction in relation to a consecutive peak along the direction of the intermediate layer, and the intermediate layer connects with each of the first and second outer layers via one of the peaks.

8. The athletic bra of claim 7, wherein each of the first and second outer layers possesses an elongation value that is less than an elongation value of the intermediate layer.

9. The athletic bra of claim 1, wherein the sections of the front portion are each formed by a flat knitting process.

10. The athletic bra of claim 9, wherein the sections are combined together as a single knit structure.

11. An athletic bra comprising:

a front portion and a rear portion, the front portion comprising a plurality of sections that form regions having different degrees of elasticity, the sections including a first cup section and a second cup section located at a central area of the front portion, wherein the sections of the front portion are oriented such that a gradient in elasticity is imparted along the front portion between the plurality of sections, and each of the first and second cup sections is imparted with an auxetic property.

12. An athletic bra comprising:

a front portion, a rear portion, and a pair of wing sections that connect the front portion with the rear portion on either side of the bra;

wherein the front portion comprises a plurality of sections that form regions having different degrees of elasticity, the sections including:

a first cup section contoured to receive a portion of a first breast of a user when the bra is worn by the user, the first cup section having a degree of elasticity defined by a first elastic modulus;

a second cup section contoured to receive a portion of a second breast of a user when the bra is worn by the user, the second cup section having a degree of elasticity defined by the first elastic modulus;

a midsection disposed between the first and second cup sections, the midsection having a degree of elasticity defined by a second elastic modulus;

a first peripheral side section disposed along a side portion of the first cup section and a second peripheral side section disposed along a side portion of the second cup section, each of the first peripheral side section and the second peripheral side section having a degree of elasticity defined by the second elastic modulus;

a bridging section disposed above the first and second cup sections, the bridging section having a degree of elasticity defined by a third elastic modulus;

a cradle section disposed below the first and second cup sections, the cradle section having a degree of elasticity defined by a fourth elastic modulus; and the first, second, third and fourth elastic moduli are different from each other.

13. The athletic bra of claim 12, wherein the first elastic modulus is greater that each of the second, third and fourth moduli.

14. The athletic bra of claim 13, wherein the second elastic modulus is less than each of the third and fourth moduli.

15. The athletic bra of claim 12, wherein the sections of the front portion are each formed by a flat knitting process.

16. The athletic bra of claim 15, wherein the sections are combined together as a single knit structure.

17. The athletic bra of claim 12, wherein each of the first and second cup sections is imparted with an auxetic property.

18. A method of forming an athletic bra comprising:

forming a front portion and a rear portion, wherein the front portion is formed as a plurality of sections that form regions having different degrees of elasticity, the sections including a first cup section and a second cup section located at a central area of the front portion, and the plurality of sections of the front portion are oriented such that a gradient in elasticity is imparted along the front portion between the plurality of sections;

wherein at least one of the sections of the front portion is formed as a knit section comprising a first outer layer, a second outer layer, and an intermediate layer disposed between and coupling together the first and second outer layers.

19. The method of claim 18, wherein the sections of the front portion are each formed by a flat knitting process in which the sections are combined together as a single knit structure.

* * * * *